US007161780B2

(12) United States Patent
Germain et al.

(10) Patent No.: US 7,161,780 B2
(45) Date of Patent: Jan. 9, 2007

(54) CIRCUIT INTERRUPTING DEVICE WITH SINGLE THROW, DOUBLE MODE BUTTON FOR TEST-RESET FUNCTION

(75) Inventors: Frantz Germain, Rosedale, NY (US); Stephen Stewart, Berrien Springs, MI (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 136 days.

(21) Appl. No.: 10/759,151

(22) Filed: Jan. 20, 2004

(65) Prior Publication Data

US 2005/0013067 A1 Jan. 20, 2005

Related U.S. Application Data

(60) Provisional application No. 60/444,548, filed on Feb. 3, 2003.

(51) Int. Cl.
*H01H 53/015* (2006.01)

(52) U.S. Cl. ..... 361/42; 361/44; 361/45; 361/46; 335/148

(58) Field of Classification Search ..... 361/42, 361/45–46, 93.1, 93.5–93.6, 104, 44; 340/635, 340/638, 653; 335/148
See application file for complete search history.

(56) References Cited

U.S. PATENT DOCUMENTS 3,042,840 A * 7/1962 Eadie, Jr. ..... 361/157
5,202,662 A 4/1993 Bienwald et al.
6,246,558 B1 * 6/2001 DiSalvo et al. ..... 361/42
6,437,700 B1 8/2002 Herzfeld et al.

* cited by examiner

*Primary Examiner*—Stephen W. Jackson
*Assistant Examiner*—Zeev Kitov
(74) *Attorney, Agent, or Firm*—Paul J. Sutton

(57) ABSTRACT

A typical duplex GFCI receptacles has two buttons, a test button that, when pressed, shuts off power to the receptacle and down stream devices, and a reset button that, when pressed, restores power to the GFCI and down stream devices. Generally, the test button is pressed to verify that the GFCI will interrupt power to the conductive paths and the reset button is pressed to reset the GFCI. In operation, the test portion of the GFCI will automatically break electrical continuity in one or more conductive paths (i.e., open the conductive path) between line and load sides upon the detection of a fault such as a reverse wiring condition, a ground fault, an open neutral and/or a defective GFCI device. When this happens the reset button in the typical GFCI receptacle is then pressed in an to attempt to restore power. The GFCI here disclosed has only one button which is used for both the test and reset operation. It is pressed to test the GFCI and its associated circuitry for operability and, only if all circuits are operable, upon release it resets the GFCI by closing open conductive paths. If, during operation, the test portion of the GFCI detects a fault and operates to shut off power to the receptacle and down stream devices, the pressing and releasing of the single button will reconnect power to the receptacle and down stream devices only if the GFCI is operational, if an open neutral condition does not exists and/or if the device is not reversed wired.

6 Claims, 5 Drawing Sheets

10
12
14
16
18
20
21
22
24
26
28
30
32
34
36
RESET
TRIP

FIG. 4
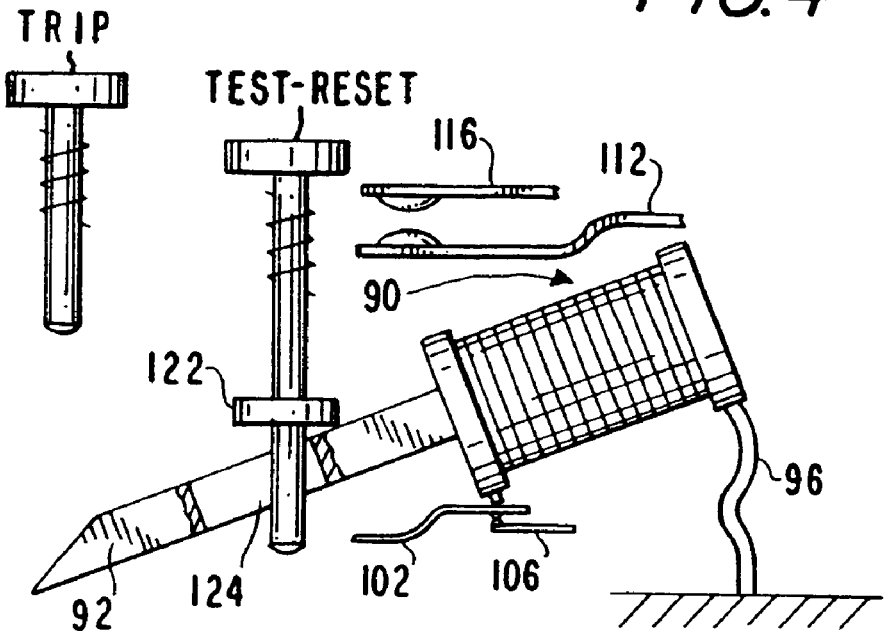
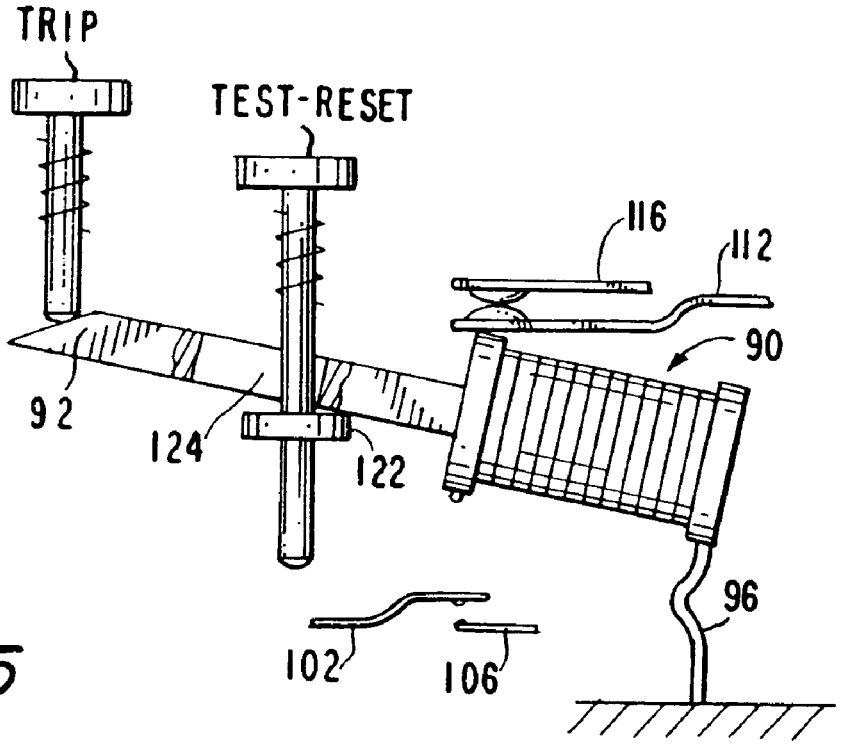
FIG. 5

CIRCUIT INTERRUPTING DEVICE WITH SINGLE THROW, DOUBLE MODE BUTTON FOR TEST-RESET FUNCTION

CROSS-REFERENCE TO RELATED APPLICATIONS

This application claims priority pursuant to 35 U.S.C 119(e) from U.S. Provisional Patent Application having application No. 60/444,548, filed Feb. 3, 2003.

BACKGROUND OF THE INVENTION

1. Field of the Invention

The present application is directed to resettable circuit interrupting devices including without limitation ground fault circuit interrupters (GFCI's), arc fault circuit interrupters (AFCI's), immersion detection circuit interrupters (IDCI's), appliance leakage circuit interrupters (ALCI's), equipment leakage circuit interrupters (ELCI's), circuit breakers, contactors, latching relays and solenoid mechanisms.

2. Description of the Related Art

Many electrical wiring devices have a line side, which is connectable to an electrical power supply, and a load side, which is connectable to one or more loads and at least one conductive path between the line and load sides. Electrical connections to wires supplying electrical power or wires conducting electricity to the one or more loads are at line side and load side connections. The electrical wiring device industry has witnessed an increasing call for circuit breaking devices or systems which are designed to interrupt power to various loads, such as household appliances, consumer electrical products and branch circuits. In particular, electrical codes require electrical circuits in home bathrooms and kitchens to be equipped with ground fault circuit interrupters (GFCI), for example. Presently available GFCI devices, such as the device described in commonly owned U.S. Pat. No. 4,595,894, use an electrically activated trip mechanism to mechanically break an electrical connection between the line side and the load side. Such devices are resettable after they are tripped by, for example, the detection of a ground fault. In the device discussed in the '894 patent, the trip mechanism used to cause the mechanical breaking of the circuit (i.e., the conductive path between the line and load sides) includes a solenoid (or trip coil). A test button is used to test the trip mechanism and circuitry used to sense faults, and a reset button is used to reset the electrical connection between line and load sides.

However, instances may arise where an abnormal condition, caused by for example a lightning strike, occurs which may result not only in a surge of electricity at the device and a tripping of the device but also a disabling of the trip mechanism used to cause the mechanical breaking of the circuit. This may occur without the knowledge of the user. Under such circumstances an unknowing user, faced with a GFCI which has tripped, may press the reset button which, in turn, will cause the device with an inoperative trip mechanism to be reset without the ground fault protection available.

Further, an open neutral condition, which is defined in Underwriters Laboratories (UL) Standard PAG 943A, may exist with the electrical wires supplying electrical power to such GFCI devices. If an open neutral condition exists with the neutral wire on the line (versus load) side of the GFCI device, an instance may arise where a current path is created from the phase (or hot) wire supplying power to the GFCI device through the load side of the device and a person to ground. In the event that an open neutral condition exists, current GFCI devices, which have tripped, may be reset even though the open neutral condition may remain.

Commonly owned U.S. Pat. No. 6,040,967, which is incorporated herein in its entirety by reference, describes a family of resettable circuit interrupting devices capable of locking out the reset portion of the device if the circuit interrupting portion is non-operational or if an open neutral condition exists. Commonly owned application Ser. No. 09/175,228, filed Sep. 20, 1998, which is incorporated herein in its entirety by reference, describes a family of resettable circuit interrupting devices capable of locking out the reset portion of the device if the circuit interrupting portion is non-operational or if an open neutral condition exists and capable of breaking electrical conductive paths independent of the operation of the circuit interrupting portion.

Some of the circuit interrupting devices described above have a user accessible load side connection in addition to the line and load side connections. The user accessible load side connection includes one or more connection points where a user can externally connect to electrical power supplied from the line side. The load side connection and user accessible load side connection are typically electrically connected together. An example of such a circuit interrupting device is a GFCI receptacle, where the line and load side connections are binding screws and the user accessible load side connection is the plug connection to an internal receptacle. As noted, such devices are connected to external wiring so that line wires are connected to the line side connection and load side wires are connected to the load side connection. However, instances may occur where the circuit interrupting device is improperly connected to the external wires so that the load wires are connected to the line side connection and the line wires are connected to the load connection. This is known as reverse wiring. In the event the circuit interrupting device is reverse wired, fault protection to the user accessible load connection may be eliminated, even if fault protection to the load side connection remains.

Furthermore, studies related to GFCI devices indicate that perhaps 10–20% or more of all GFCI devices installed were found to be inoperable by the user. However, after those devices were returned to the manufacturer, most were found to be operational. Accordingly, it has been suggested that the devices were reverse wired by the user (line—load side reversal). Furthermore, regulatory codes and industry standards codes such as those by Underwriters Laboratories (UL) may require that GFCI devices be manufactured with a warning label advising the user to correctly wire the line and load terminals of the device. However, even such warnings may not be adequate as suggested by the studies above. Furthermore, a reasonably foolproof mis-wiring prevention scheme may obviate the need for such a warning label.

Conventional GFCI devices may utilize a user load such as a face receptacle. Typically GFCIs are four terminal devices, two line leads for connection to AC electrical power and two LOAD leads for connection to downstream devices. If a conventional GFCI is properly wired, the GFCI provides ground fault protection for devices downstream and the incorporated receptacle. However, if a conventional GFCI is reverse wired, unprotected power is provided to the receptacle face at all times. For example, when a conventional GFCI is reverse wired, the face receptacle is "upstream" from the current imbalance sensor coil. Accordingly, if the conventional GFCI is in either the tripped or normal state, the face receptacle is provide unprotected power.

In spite of detailed instructions that come packaged with most GFCIs and identification of AC and LOAD terminals, GFCIs are sometimes mis-wired. One reason that this problem exists is that in new construction, both the input line and downstream cables appear identical when the installer is connecting a new ground fault circuit interrupter. This is especially a problem in new construction where there is no power available in order to test which cable is leading current into the device.

The problem may be compounded when it is considered that many typical duplex receptacle GFCIs have a test button that will trip and shut off the power when pushed to verify operations of internal functions in the GFCI. However, use of the test button does not indicate whether the built in duplex receptacle is protected. Typical users may not be aware of this. Users simply test the device after installation and verify that the unit trips upon pressing the test button by way of an audible click, for example. This gives the user a false sense that all is well. What is actually happening when the GFCI is reverse wired is that the GFCI disconnects power from and protects everything downstream, but does not protect the receptacle contacts of the GFCI itself. The device will trip depending on the condition of internal components and irrespective of how the GFCI was wired. It does not matter that the GFCI was reverse wired when it was tested.

SUMMARY OF THE INVENTION

The present invention relates to a resettable circuit interrupting devices that has a single throw, double mode button where, on the down stroke, a test operation is initiated and, if successful, on the up stroke does a reset operation to connect a load to a line.

In one embodiment, the circuit interrupting device includes a housing and phase and neutral conductive paths disposed at least partially within the housing between line and load sides. Preferably, the phase conductive path terminates at a first connection capable of being electrically connected to a source of electricity, a second connection capable of conducting electricity to at least one load and a third connection capable of conducting electricity to at least one user accessible load. Similarly, the neutral conductive path, preferably, terminates at a first connection capable of being electrically connected to a source of electricity, a second connection capable of providing a neutral connection to the at least one load and a third connection capable of providing a neutral connection to the at least one user accessible load;

The circuit interrupting device also includes a circuit interrupting portion that is disposed within the housing and configured to cause electrical discontinuity in one or both of the phase and neutral conductive paths, between said line side and said load side upon the occurrence of a predetermined condition. A reset portion is disposed at least partially within the housing and is configured to reestablish electrical continuity in the open conductive paths.

The phase conductive path includes a plurality of contacts that are capable of opening to cause electrical discontinuity in the phase conductive path and closing to reestablish electrical continuity in the phase conductive path, between said line and load sides. The neutral conductive path also includes a plurality of contacts that are capable of opening to cause electrical discontinuity in the neutral conductive path and closing to reestablish electrical continuity in the neutral conductive path, between said line and load sides. In this configuration, the circuit interrupting portion causes the plurality of contacts of the phase and neutral conductive paths to open, and the reset portion causes the plurality of contacts of the phase and neutral conductive paths to close.

The circuit interrupting portion uses an electro-mechanical circuit interrupter to cause electrical discontinuity in the phase and neutral conductive paths, and sensing circuitry to sense the occurrence of the predetermined condition. For example, the electro-mechanical circuit interrupter may include a coil assembly having a movable plunger. The movable plunger is responsive to energizing of the coil assembly and cooperates with a holding member which positions and holds the plunger in a first position to test the operability of the circuits and a second position to provide electrical continuity for the phase and/or neutral conductive paths if the test of the circuits were successful.

The circuit interrupting device also prevents the reestablishing of electrical continuity in either the phase or neutral conductive path or both conductive paths, if the circuit interrupting portion is not operating properly. That is, the device cannot be reset unless the circuit interrupting portion is operating properly.

The circuit interrupting device may also include a trip portion that operates independently of the circuit interrupting portion. The trip portion is disposed at least partially within the housing and is configured to cause electrical discontinuity in the phase and/or neutral conductive paths independent of the operation of the circuit interrupting portion. In one embodiment, the trip portion includes a trip actuator accessible from an exterior of the housing and a trip arm preferably within the housing and extending from the trip actuator. The trip arm is preferably configured to facilitate mechanical breaking of electrical continuity in the phase and/or neutral conductive paths, if the trip actuator is actuated. The trip actuator is a button. However, other known actuators are also contemplated.

For a better understanding of the invention, together with other details and features thereof, reference is made to the following description taken in connection with the accompanying drawings.

BRIEF DESCRIPTION OF THE DRAWINGS

Preferred embodiments of the present application are described herein with reference to the drawings in which similar elements are given similar reference characters, wherein:

FIG. 4 is a side view of FIG. 1 when the main contacts are open and the test contacts are closed;

FIG. 5 is a side view of FIG. 1 when the main contacts are closed and the test contacts are open;

DETAILED DESCRIPTION

Figure 1:
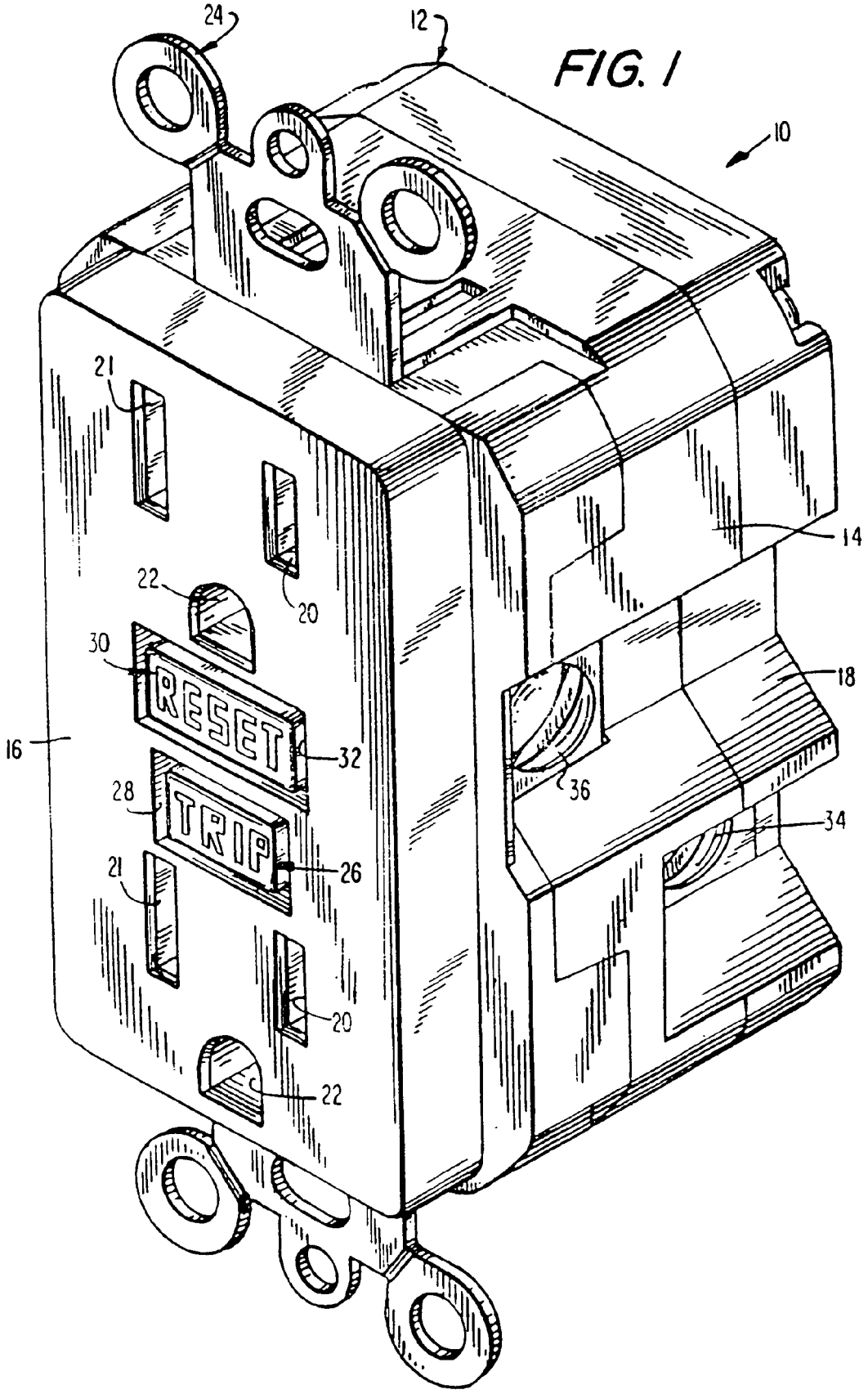
FIG. 1 is a perspective view of one embodiment of a ground fault circuit interrupting device according to the present application.

The present invention contemplates various types of circuit interrupting devices that are capable of breaking at least one conductive path between a line side and a load side of the device. The conductive path is typically divided between a line side that connects to supplied electrical power and a load side that connects to one or more loads. As noted, the various devices in the family of resettable circuit interrupting devices include: ground fault circuit interrupters (GFCI's), arc fault circuit interrupters (AFCI's), immersion detection circuit interrupters (IDCI's), appliance leakage circuit interrupters (ALCI's) and equipment leakage circuit interrupters (ELCI's).

The invention shown in the drawings and described hereinbelow, is incorporated into a GFCI receptacle suitable for installation in a single-gang junction box used in, for example, a residential electrical wiring system. However, the mechanisms according to the present invention can be included in any of the various devices in the family of resettable circuit interrupting devices.

The GFCI receptacles described herein have line and load phase (or power) connections, line and load neutral connections and user accessible load phase and neutral connections. The connections permit external conductors or appliances to be connected to the device. These connections may be, for example, electrical fastening devices that secure or connect external conductors to the circuit interrupting device, as well as conduct electricity. Examples of Such connections include binding screws, lugs, terminals and external plug connections.

In one embodiment, the GFCI receptacle has a reset portion, a test portion, and an independent trip portion where the reset and test portions are sequentially selectively activated by a single throw, dual mode reset button where, on the down push stroke, a test is performed to determine operability of the GFCI and proper functioning of the associated wiring and, on the release or up stroke, the GFCI is reset to establish electrical continuity in the conductive paths if the test indicated that all circuits were operating properly. The trip portion operates independently of the reset and test portions and is used to break the electrical continuity in one or more conductive paths in the device.

The interrupting portion of the device includes fault detecting circuitry and circuit interrupting portion (i.e., solenoid). These two portions operate together to trip the device (open the main contacts) when a first predetermined condition is detected (i.e., ground fault or arc fault).

The test portion includes a switch which, when closed, introduces a "pseudo-fault" that is detected by the fault detecting circuitry of the circuit interrupting portion. This causes the circuit interrupting portion to fire. The switch is located in such a position that, if the solenoid fires while the switch is closed, the device can be reset. If the solenoid does not fire, the device cannot be reset. Thus, the test portion tests for a second predetermined condition (i.e., non-working GFCI, line-load wire reversal, open neutral). If any of these conditions are present, the solenoid will not fire and the device cannot be reset.

The test and interrupting portions described herein preferably use electromechanical components to break (open) and make (close) one or more conductive paths between the line and load sides of the device. However, electrical components, such as solid state switches and supporting circuitry, may be used to open and close the conductive paths.

Generally, the test portion is used to prevent electrical continuity in one or more conductive paths (i.e., keep the conductive path open) between the line and load sides upon the detection of a fault, such as a reverse wiring condition, an open neutral and/or a defective GFCI device. The reset portion is used to close the open conductive paths.

In the embodiment, the test and reset portion includes a single button which is used to first test the GFCI and its associated circuitry for operability and, if the test indicates that all circuits are operable, to close the open conductive paths. In this invention, electrical continuity in open conductive paths cannot be reset if the test shows that the device is non-operational, if an open neutral condition exists and/or if the device is reverse wired.

In the embodiment, an independent trip portion is included to break electrical continuity in one or more conductive paths independently of the operation of the device. Thus, in the event the device is not operating properly, it can still be tripped.

The above-described features can be incorporated in any resettable circuit interrupting device, but for simplicity the description herein is directed to GFCI receptacles.

Turning now to FIG. 1, the GFCI receptacle 10 has a housing 12 consisting of a relatively central body 14 to which a face or cover portion 16 and a rear portion 18 are removably secured. The face portion 16 has entry ports 20 and 21 for receiving normal or polarized prongs of a male plug of the type normally found at the end of a lamp or appliance cord set (not shown), as well as ground-prong-receiving openings 22 to accommodate a three-wire plug. The receptacle also includes a mounting strap 24 used to fasten the receptacle to a junction box.

A trip button 26 extends through opening 28 in the face portion 16 of the housing 12. The trip button is used to activate a trip operation, that trips the operation of the circuit interrupting portion (or circuit interrupter) disposed in the device. The circuit interrupting portion, to be described in more detail below, is used to break electrical continuity in one or more conductive paths between the line and load side of the device. A reset button 30 forming a part of the reset and test portions extends through opening 32 in the face portion 16 of the housing 12. The reset button is a single throw, double mode reset button used to first activate a test operation when depressed and, upon release, initiate a reset operation, to reestablish electrical continuity in the open conductive paths only if the test operation indicated that the circuits tested were operating properly. Thus, the reset button performs two functions in sequence with a single throw.

In the embodiment, electrical connections to existing household electrical wiring are made via binding screws 34 and 36, where screw 34 is an input (or line) phase connection, and screw 36 is an output (or load) phase connection. It should be noted that two additional binding screws are located on the opposite side of the receptacle 12. These additional binding screws provide line and load neutral connections, respectively. A more detailed description of a GFCI receptacle is provided in U.S. Pat. No. 4,595,894, which is incorporated herein in its entirety by reference. It should also be noted that binding screws are exemplary of the types of wiring terminals that can be used to provide the electrical connections. Examples of other types of wiring terminals include set screws, pressure clamps, pressure plates, push-in type connections, pigtails and quick-connect tabs.

Referring to FIGS. 2–5, there is illustrated components used during testing and resetting operations in accordance with the principles of the invention. The testing portion has a circuit interrupter and electronic circuitry capable of sensing faults, e.g., current imbalances, on the hot and/or neutral conductors. In the embodiment for the GFCI receptacle, the circuit interrupter includes a coil assembly or solenoid 90, a plunger 92 having a rectangular cross section responsive to the energizing and de-energizing of the coil assembly, and a reset pin that interacts with the plunger 92. The coil assembly 90 is activated in response to the sensing of a ground fault by, for example, the sense circuitry shown in FIG. 6, which is a wiring schematic of circuitry for detecting ground faults that includes at least one differential transformer that senses current imbalances.

Figure 6:
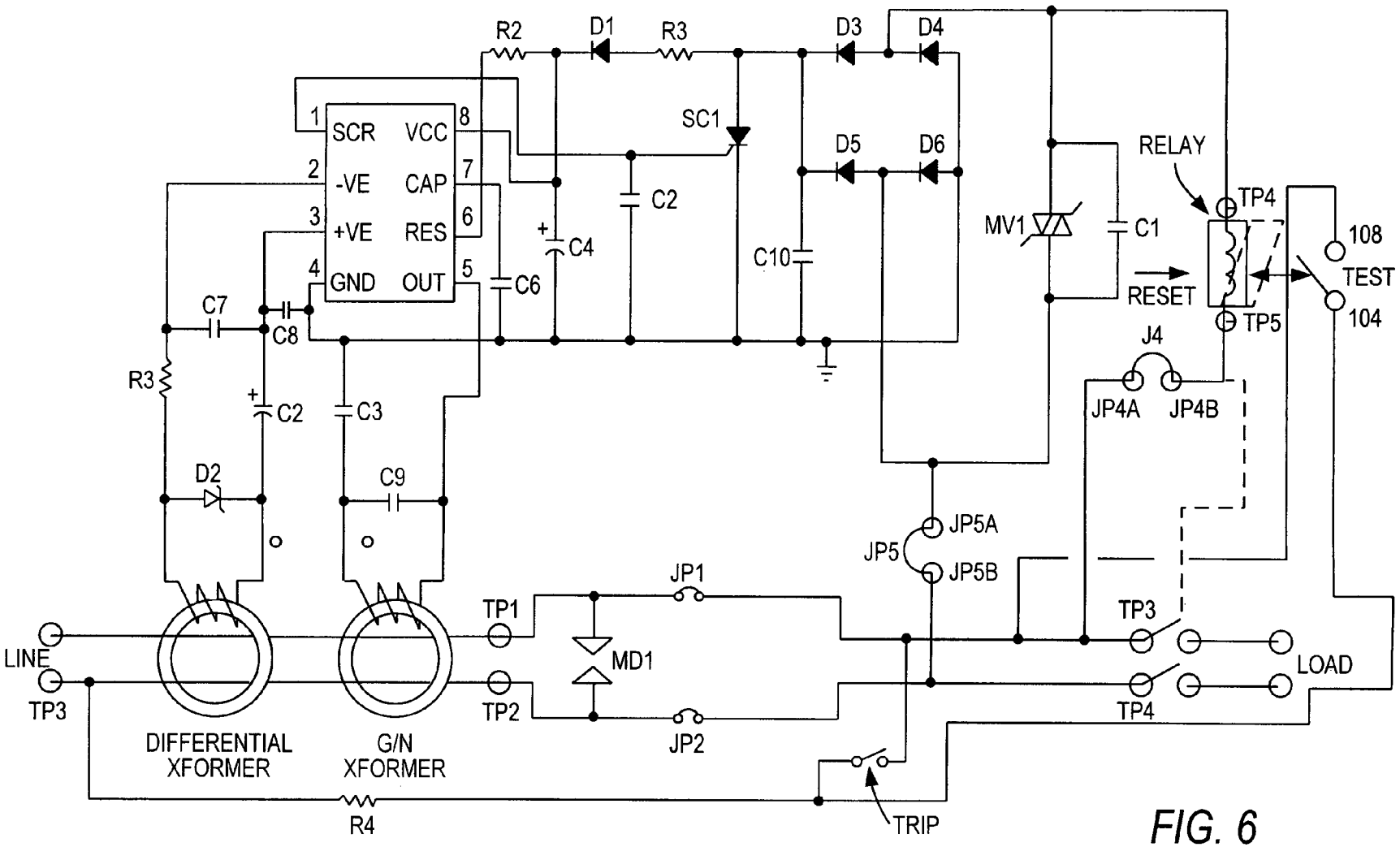
FIG. 6 is a schematic diagram of a circuit for testing for circuit faults and resetting the GFCI device of FIG. 1.

The solenoid 90 is flexibly mounted to the back cover of the GFCI, or to the printed wiring board or the strap or any other convenient member of the GFCI by means of a flexible spring support member 96. Spring support member 96 is coupled securely to the rear end of the solenoid and anchored to, for example, the back cover of the GFCI to allow the front portion 98 of the solenoid to pivot or rock up and down about the spring 96 when a force in the up or down direction is applied to the plunger 92. The pivoting motion of the solenoid is shown in FIG. 6 by the dashed lined box and the arrow between the actuator and the relay which includes a coil assembly and solenoid. In addition, the dashed line from the relay to the relay test contacts represents a mechanical link between the two components. Referring back to FIGS. 2–5, the front 98 of the solenoid 90 supports a contacting plate 100 which can be composed of insulating material and which moves down with the front of the solenoid as it moves down, and up when the front of the solenoid moves up. Located immediately below contacting plate 100 is a movable arm 102 that supports a movable contact 104 and a fixed arm 106 which supports a fixed contact 108. Movable contact 104 cooperates with fixed contact 108. Contacts 104, 108 are test contacts 110 (see FIG. 6) which, when closed, allows the circuit of FIG. 6 to perform the test function which determines if the GFCI and associated circuitry is operating properly. When, on closing test contacts 110, the test circuit of FIG. 6 shows that all the circuits are operating properly, the solenoid 90 will be energized and plunger 92 will be drawn into the body of the solenoid and remains there until the test contacts are opened.

Figure 2:
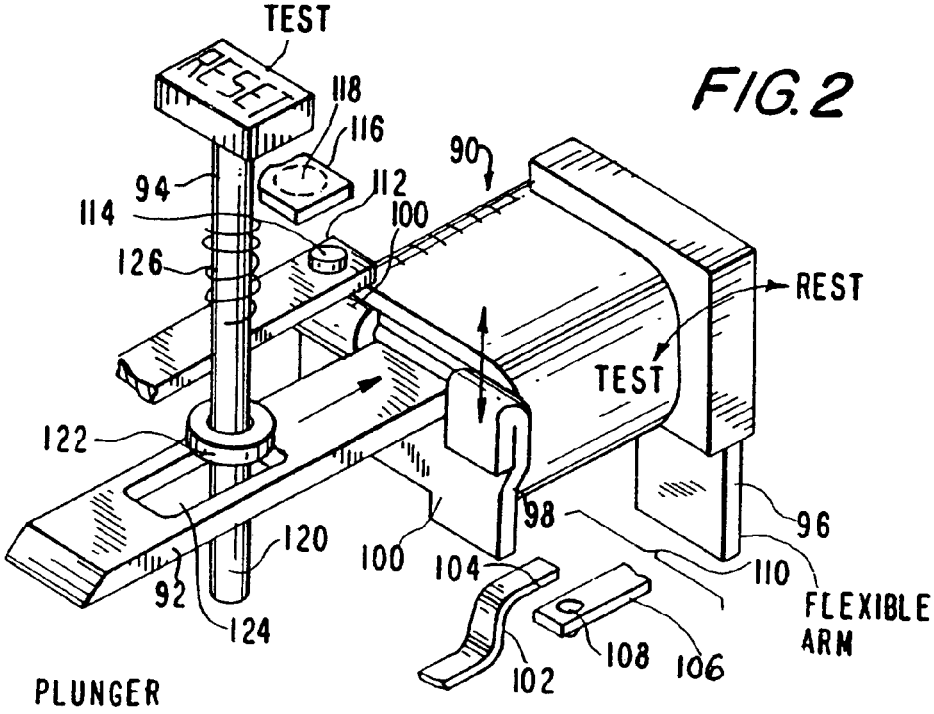
FIG. 2 is an isometric view of portions of structure in accordance with the principles of the invention located within the GFCI device of FIG. 1.
Figure 7:
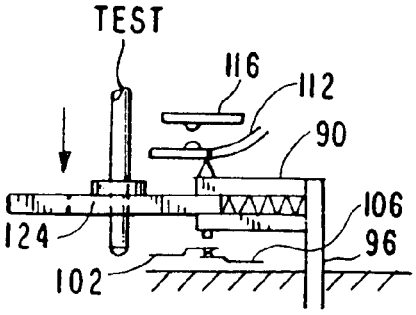
FIGS. 7–9 are side elevation views showing the relationship of the trip arm, plunger, solenoid and trip and main contacts during different portions of the operating cycle.
Figure 8:
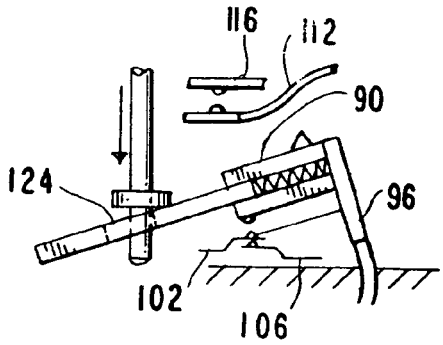
Figure 9:
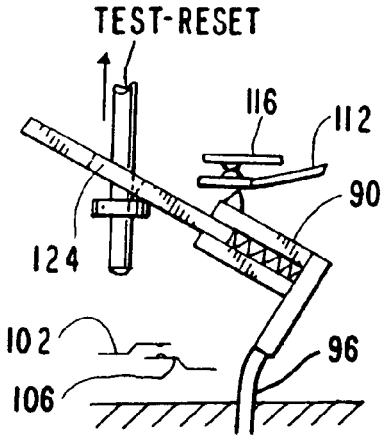
Figure 3:
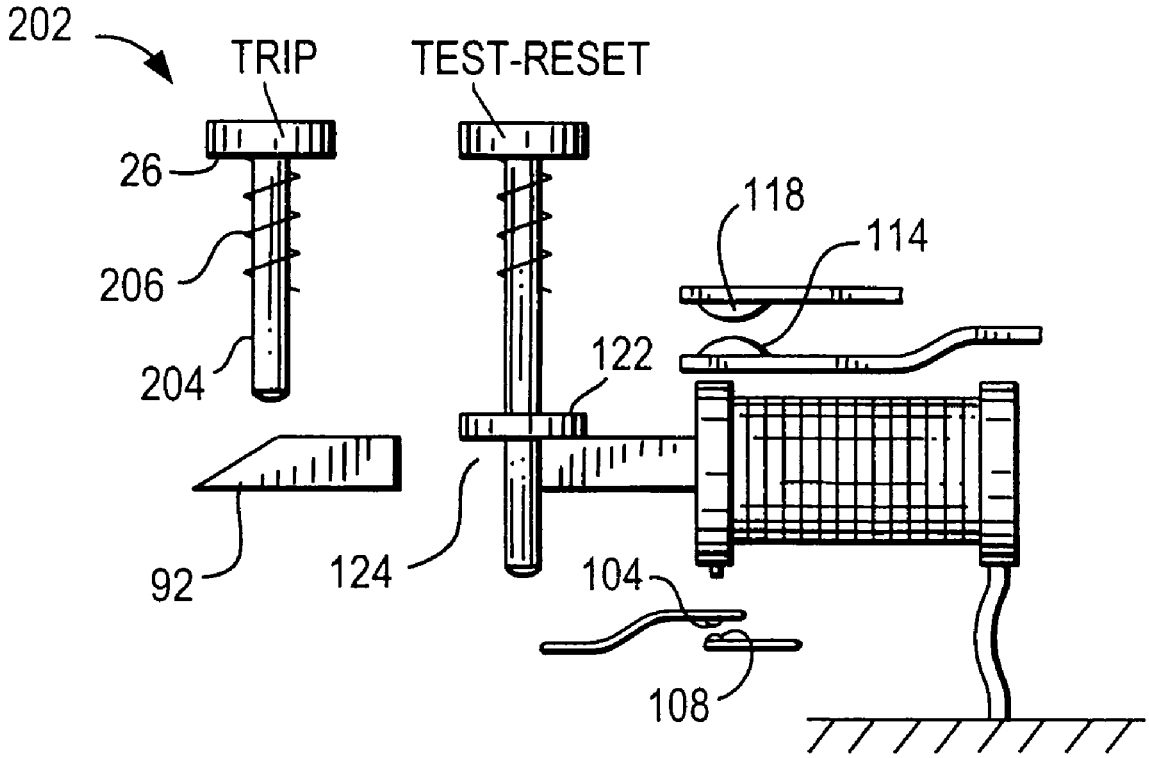
FIG. 3 is a side view of FIG. 1 when the main contacts and test contacts are open.

Located immediately above insulating contacting plate 100 is a movable arm 112 that supports a movable line phase contact 114 and a fixed arm 116 which supports a fixed load phase contact 118. The positioning of the contacting plate, the test contacts 104, 108, and the line or load contacts 114, 118 are such that both sets of contacts are open (not contacting) when the solenoid is in its inactive horizontal position as shown in FIGS. 2 and 3. When the solenoid is positioned to be in the test position where the solenoid is in the down position as shown in FIG. 4, the test contacts 104, 108, are contacting (closed). When the solenoid is positioned to be in the reset position where the solenoid is in the up position as shown in FIG. 5, the main (line and load) contacts 114, 118 are closed.

The plunger 92 of the solenoid 90 supports an oval or rectangular shaped opening 124 having its long axis aligned with the long dimension of the plunger and its short axis aligned with the width of the plunger. The shaped opening is sized to allow a reset pin 120 and a circular shaped holding projection 122 rigidly attached to the lower end of the reset pin to pass thru the opening 124. Reset pin 120 is biased by a return spring 126 to move up. The geometry and relationship of plunger 92 and reset pin 94 are such that when the solenoid is not conducting the plunger is fully extended and the holding projection 122 is located either on top of or under the plunger and is offset relative to opening 124 such that holding projection can not pass thru opening 124. Thus, the circular shaped projection is not aligned with the opening 124 and, therefore, cannot pass through the opening (see FIGS. 3–5). Thus, when the holding projection is positioned on top of plunger 92, a downward force on the reset pin will exert a downward force of the plunger which, in turn, will urge the plunger 92 and the coil 90 to swing down against the resisting force of the supporting spring 96. In a similar manner, when the holding projection is positioned is positioned below the plunger 92, the return spring 126 around the reset pin will exert an upward force on the plunger which, in turn, will urge the plunger 92 and coil 90 to swing up against the resisting force of the supporting spring 96.

The reset pin 94 is biased to be in the up position by return spring 126. Initially, the solenoid is in its horizontal position (see FIG. 3). The holding projection 122 is located on top of the plunger and not in alignment with opening 124, and the contacts under and above the solenoid are open. A downward force now applied to the reset button will act against the upward force of the return spring to move the reset button down. The holding projection 122, not being aligned with opening 124 in the plunger, contacts the upper surface of the plunger and forces it to move down against the returning force of support spring 96. At some instance, insulating contacting plate 100 contacts and moves the movable contact arm 102 down to close the test contacts 104, 108 of the circuit of FIG. 6 and a test is performed. If the test shows that a defect is present, then nothing further happens because the solenoid is not energized. It does not fire. The solenoid assembly remains in the down position and the main line-load contacts 114, 118 do not close.

If, however, the test shows that all circuits are operating properly, then the solenoid 90 is energized and the plunger is drawn into the solenoid. As the plunger moves into the solenoid, the opening in the plunger moves toward the right and the opening in the plunger moves into alignment with the holding member 122. At this instant, as downward pressure is being applied to the reset button, the holding projection falls through the opening and is then located below the bottom surface of the plunger. When the holding member falls through the opening, the solenoid, through the biasing action of the support spring, is urged to return to its horizontal position and the test contacts open. As the test contacts open, the flow of current to the solenoid is stopped, the plunger is biased to return to its extended position by the plunger return spring and the holding projection on the end of the reset pin is now located under the plunger and not in alignment with the opening. The downward force is now removed from the reset button and the reset button return spring urges the reset pin to move up. The upward force of the reset pin return spring is greater than the restoring force of the support spring and, therefore, as the reset pin moves up, the holding projection 124, which is now located under the plunger and not in alignment with opening, pulls the plunger and solenoid 90 to the up position until the insulating contacting plate contacts and closes the main contacts 114, 118 which allows current to flow from the source to the load. See FIG. 4.

Thus, the reset button, with a single throw, that of being pressed down and then being released and allowed to return to its up position, performs a double mode function, that of first testing the circuit and if the circuit tested passes the test, resetting the circuit to allow power to be passed to the load.

If, when the solenoid is in the reset state (the up position) and the reset button is pressed, the main contacts will open and remain open only while the reset button is held down.

The main contacts will then close as soon as the reset button is released because the holding projection is still located under the plunger.

If, for some reason while the main contacts are closed and power is being supplied to the load, the circuit of FIG. 6 senses a fault condition, power will be applied to the coil 90, the solenoid will fire and the plunger will be drawn into the coil. As the plunger is drawn into the solenoid, the opening in the plunger will align itself with the holding projection 122 and the return spring 126 will pull the holding projection thru opening 124 to the top of the plunger. The plunger, being disengaged from the holding projection, will be urged to move down to the horizontal position by the support spring. As the plunge moves to the horizontal position, the power contacts 114, 118 open and power will no longer be supplied to the load. At this time the holding projection is located on top of the plunger and is offset from the opening as seen in FIG. 3. If the reset button is now pressed, the holding projection will press down of the plunger to cause the front of the solenoid to tilt down and the test contacts to close. If all circuits are operating properly, the power contacts 114, 118 will be closed, but will immediately open if the fault condition is still present.

The circuit interrupting device may also include a trip portion that operates independently of the circuit interrupting portion so that in the event the circuit interrupting portion becomes non-operational the device can still be tripped. Preferably, the trip portion is manually activated and uses mechanical components to break one or more conductive paths. However, the trip portion may use electrical circuitry and/or electromechanical components to break either the phase or neutral conductive path of both paths.

A trip actuator 202, preferably a button, which is part of the trip portion extends through opening 28 in the face portion 16 of the housing 12. The trip actuator is used, in this exemplary embodiment, the mechanically trip the GFCI receptacle, i.e., break electrical continuity in one or more of the conductive paths, independent of the operation of the circuit interrupting portion.

A reset actuator 30, preferably a button, which is part of the reset portion, extends through opening 32 in the face portion 16 of the housing 12. The reset button is used to activate the reset operation, which re-establishes electrical continuity in the open conductive paths, i.e., resets the device, if the circuit interrupting portion is operational.

Referring to FIG. 3, an exemplary embodiment of the trip portion includes a trip actuator 202, preferably a button securely connected to a trip arm 204 connected to a spring 206 which biases the trip arm to be in the up position. The trip arm includes a surface at its end positioned to engage the end of the plunger 92 as the trip arm is depressed to move the plunger into the solenoid. Referring to FIG. 5 where the device is in the conductive state where power is being supplied to a load through closed contacts 114, 118, depressing the reset button causes the trip arm to move down to engage the end of the plunger 92 and move it into the solenoid. As the plunger is moved into the solenoid, the oval opening in the plunger moves into alignment with the holding member and, through the action of the support spring, the holding projection passes through the oval opening allowing the plunger to tip down to assume a horizontal position and open the contacts 114, 118.

With reference to the embodiment disclosed, the mechanical trip mechanism can operate to trip the circuit interrupting device at any time the device is reset. It is to be understood that the invention is not restricted to the embodiment of the trip mechanism disclosed, and that other mechanical or electromechanical structures can be used. For example, in place of the oval opening, the holding projection and the trip arm can be located to contact the plunger at the end where the holding projection is positioned to contact the plunger at one location at the end of the rectangular plunger and the end of the trip arm contacts the plunger at a second location at the end of the rectangular plunger.

As noted, although the components used during circuit interrupting and device reset operations are electro-mechanical in nature, the present application also contemplates using electrical components, such as solid state switches and supporting circuitry, as well as other types of components capable or making and breaking electrical continuity in the conductive path.

While there have been shown and described and pointed out the fundamental features of the invention, it will be understood that various omissions and substitutions and changes of the form and details of the device described and illustrated and in its operation may be made by those skilled in the art, without departing from the spirit of the invention.

What is claimed is:

1. A circuit interrupting device comprising:

a housing;

a phase conductive path disposed at least partially within said housing between a line side and a load side, said phase conductive path terminating at a first connection capable of being electrically connected to a source of electricity, a second connection capable of conducting electricity to at least one load and a third connection capable of conducting electricity to at least one user accessible load;

a circuit interrupting portion comprising a solenoid pivotly supported by a flexible support member disposed within said housing and configured to cause electrical discontinuity in said phase conductive path between said line side and said load side upon the occurrence of a first predetermined condition; and a reset actuator disposed at least partially within said housing which, when depressed, causes the solenoid to pivot about the flexible support member to close test contacts to initiate a test to determine if the first predetermined condition is present, and to provide electrical continuity in said phase conductive path between said line side and said load side if the test determined that the first predetermined condition and a second predetermined condition is not present.

2. The circuit interrupting device of claim 1 wherein the reset actuator is a single throw, double mode push button.

3. The circuit interrupting device of claim 1 wherein the reset actuator is a button which, when depressed initiates the test and when released provides electrical continuity in said phase conductive path between said line side and said load side if the test determined that a second predetermined condition is not present.

4. The circuit interrupting device of claim 3 wherein the reset actuator comprises a button biased by spring means which urges the button to return to its initial position.

5. The circuit interrupting device of claim 1 wherein the second predetermined condition comprises defective operation of the circuit interrupting portion, or an open neutral condition, or a reverse wiring condition.

6. A circuit interrupting device comprising:

a housing;

a phase conductive path and a neutral conductive path each disposed at least partially within said housing between a line side and a load side, said phase conductive path terminating at a first connection capable of being electrically connected to a source of electricity, a second connection capable of conducting electricity to at least one load and a third connection capable of conducting electricity to at least one user accessible load, and said neutral conductive path terminating at a first connection capable of being electrically connected to a source of electricity, a second connection capable of providing a neutral connection to said at least one load and a third connection capable of providing a neutral connection to said at least one user accessible load;

a circuit interrupting portion comprising a solenoid pivotly supported by a flexible support member disposed within said housing and configured to cause electrical discontinuity in said phase and neutral conductive paths between said line side and said load side upon the occurrence of a first predetermined condition;

a reset actuator disposed within said housing which, when depressed, causes the solenoid to pivot about the flexible support member to close test contacts to determine the presence of a second predetermined condition is present and if said second predetermined condition is not present, establish electrical continuity in said phase and neutral conductive paths; and a trip portion configured to cause electrical discontinuity in said phase and neutral conductive paths between said line side and said load side.

* * * * *